US011603250B2

(12) United States Patent
Hashimoto et al.

(10) Patent No.: US 11,603,250 B2
(45) Date of Patent: Mar. 14, 2023

(54) CUSHIONING MEMBER, PACKING BODY, AND PACKING METHOD

(71) Applicant: KONICA MINOLTA, INC., Tokyo (JP)

(72) Inventors: Takeshi Hashimoto, Okazaki (JP); Narutaka Yoshida, Toyokawa (JP); Hiromi Mizuguchi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 126 days.

(21) Appl. No.: 16/919,571

(22) Filed: Jul. 2, 2020

(65) Prior Publication Data

US 2021/0016949 A1 Jan. 21, 2021

(30) Foreign Application Priority Data

Jul. 18, 2019 (JP) ..... JP2019-132438

(51) Int. Cl.
*B65D 81/05* (2006.01)
*B65D 81/107* (2006.01)
*B65D 5/50* (2006.01)

(52) U.S. Cl.
CPC ..... *B65D 81/107* (2013.01); *B65D 5/509* (2013.01); *B65D 2581/053* (2013.01)

(58) Field of Classification Search
CPC .. B65D 81/107; B65D 81/052; B65D 81/053; B65D 81/054; B65D 81/055; B65D 81/056; B65D 81/05; B65D 85/307
USPC ..... 206/521, 522, 586
See application file for complete search history.

(56) References Cited

U.S. PATENT DOCUMENTS

| | | | | |
|---|---|---|---|---|
| 7,727,614 | B2 * | 6/2010 | Stubing | B65D 81/053 229/199 |
| 2017/0144819 | A1 * | 5/2017 | Itano | B65D 81/133 |
| 2017/0198737 | A1 * | 7/2017 | Yang | B65D 61/00 |

FOREIGN PATENT DOCUMENTS

| | | | | |
|---|---|---|---|---|
| JP | H06144465 | A | 5/1994 | |
| JP | 07149372 | * | 6/1995 | B65D 81/054 |
| JP | 2003292051 | * | 10/2003 | B65D 19/34 |

* cited by examiner

*Primary Examiner* — Steven A. Reynolds
(74) *Attorney, Agent, or Firm* — Buchanan Ingersoll & Rooney PC

(57) ABSTRACT

A cushioning member includes a cushioning material arranged between a side surface of an object and an exterior box and a positioning member for positioning of the cushioning material with respect to the object. The positioning member includes a holding portion that holds the cushioning material, an engagement portion engaged with an upper surface of the object while the cushioning material held by the holding portion is located at a position set in advance in the side surface of the object, and a coupling portion that couples the holding portion and the engagement portion to each other.

8 Claims, 5 Drawing Sheets

CUSHIONING MEMBER, PACKING BODY, AND PACKING METHOD

The entire disclosure of Japanese Patent Application No. 2019-132438 filed on Jul. 18, 2019 is incorporated herein by reference in its entirety.

BACKGROUND

Technological Field

The present invention relates to a cushioning member, a packing body, and a packing method.

Description of the Related Art

A cushioning member used in packing of an object to be packed (an object) has conventionally been known. For example, Japanese Laid-Open Patent Publication No. 6-144465 discloses a cushioning member including a tubular corrugated cardboard material and an air cushion arranged inside the corrugated cardboard material. This cushioning member is arranged between a bottom box that receives an apparatus (an object) and a side surface of the apparatus in such a position that a central axis of the corrugated cardboard material extends in a vertical direction. Protection of the side surface of the apparatus and positioning of the cushioning member with respect to the apparatus are thus both achieved.

SUMMARY

The structure described in Japanese Laid-Open Patent Publication No. 6-144465 requires the bottom box for positioning of the cushioning member with respect to the side surface of the apparatus and hence the number of components is large.

An object of the present invention is to provide a cushioning member of which position with respect to an object is determined with a simplified structured body, the cushioning member being capable of maintaining restraint less likely to allow displacement of positions of the cushioning member and the object also during transportation, a packing body including the cushioning member, and a packing method by using the cushioning member.

To achieve at least one of the abovementioned objects, according to an aspect of the present invention, a cushioning member reflecting one aspect of the present invention is arranged between an object including an upper surface and a plurality of side surfaces and an exterior box in which the object is packed, and the cushioning member comprises a cushioning material arranged between a side surface of the object and the exterior box and a positioning member for positioning of the cushioning material with respect to the object. The positioning member includes a holding portion that holds the cushioning material, an engagement portion engaged with the upper surface of the object while the cushioning material held by the holding portion is located at a position set in advance in the side surface of the object, and a coupling portion that couples the holding portion and the engagement portion to each other.

To achieve at least one of the abovementioned objects, according to an aspect of the present invention, a packing body reflecting one aspect of the present invention comprises the cushioning member, the object, and the exterior box. The engagement portion is engaged with the upper surface of the object while the cushioning material held by the holding portion is located at the position set in advance in the side surface of the object.

To achieve at least one of the abovementioned objects, according to an aspect of the present invention, a packing method reflecting one aspect of the present invention is a packing method of packing the object in the exterior box by using the cushioning member. In the packing method, the object and the cushioning member are covered with the exterior box while the cushioning material held by the holding portion is located at the position set in advance in the side surface of the object and the engagement portion is engaged with the upper surface of the object.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
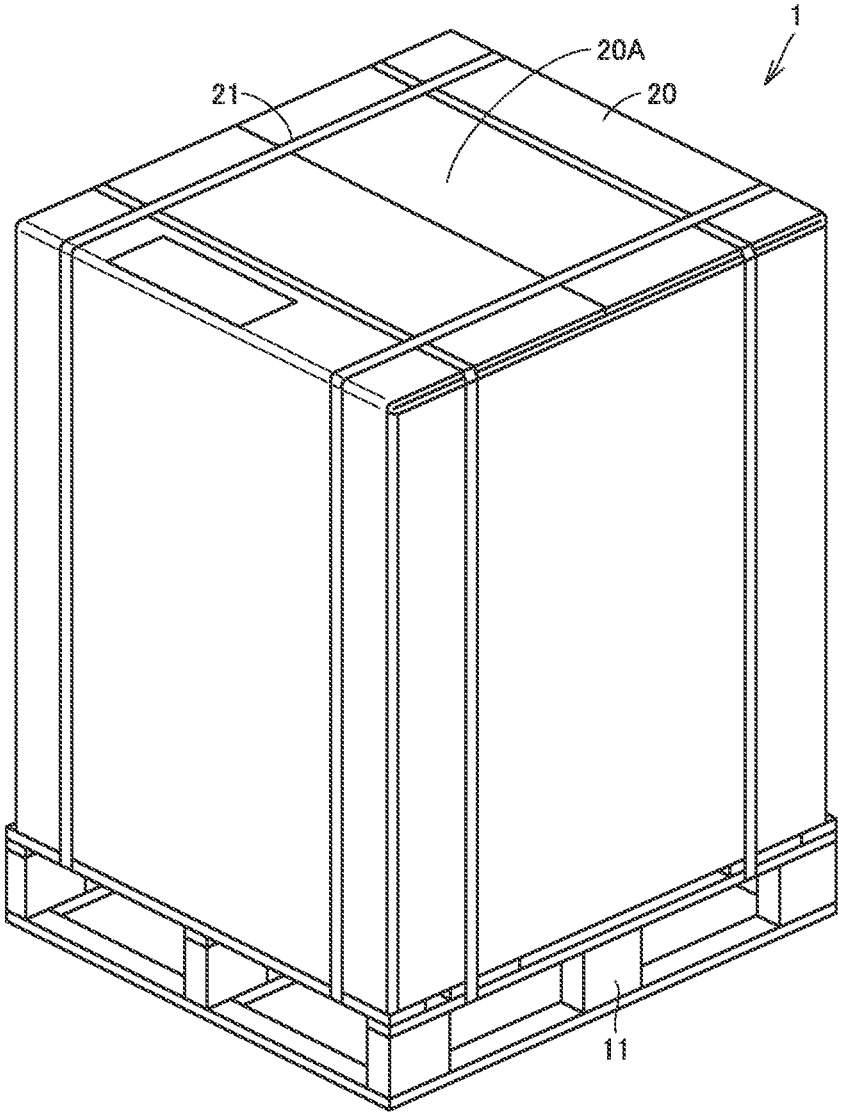
FIG. 1 is a perspective view schematically showing a packing body in one embodiment of the present invention.

Hereinafter, one or more embodiments of the present invention will be described with reference to the drawings. However, the scope of the invention is not limited to the disclosed embodiments. In the drawings referred to below, the same or corresponding member has the same reference numeral allotted.

Figure 2:
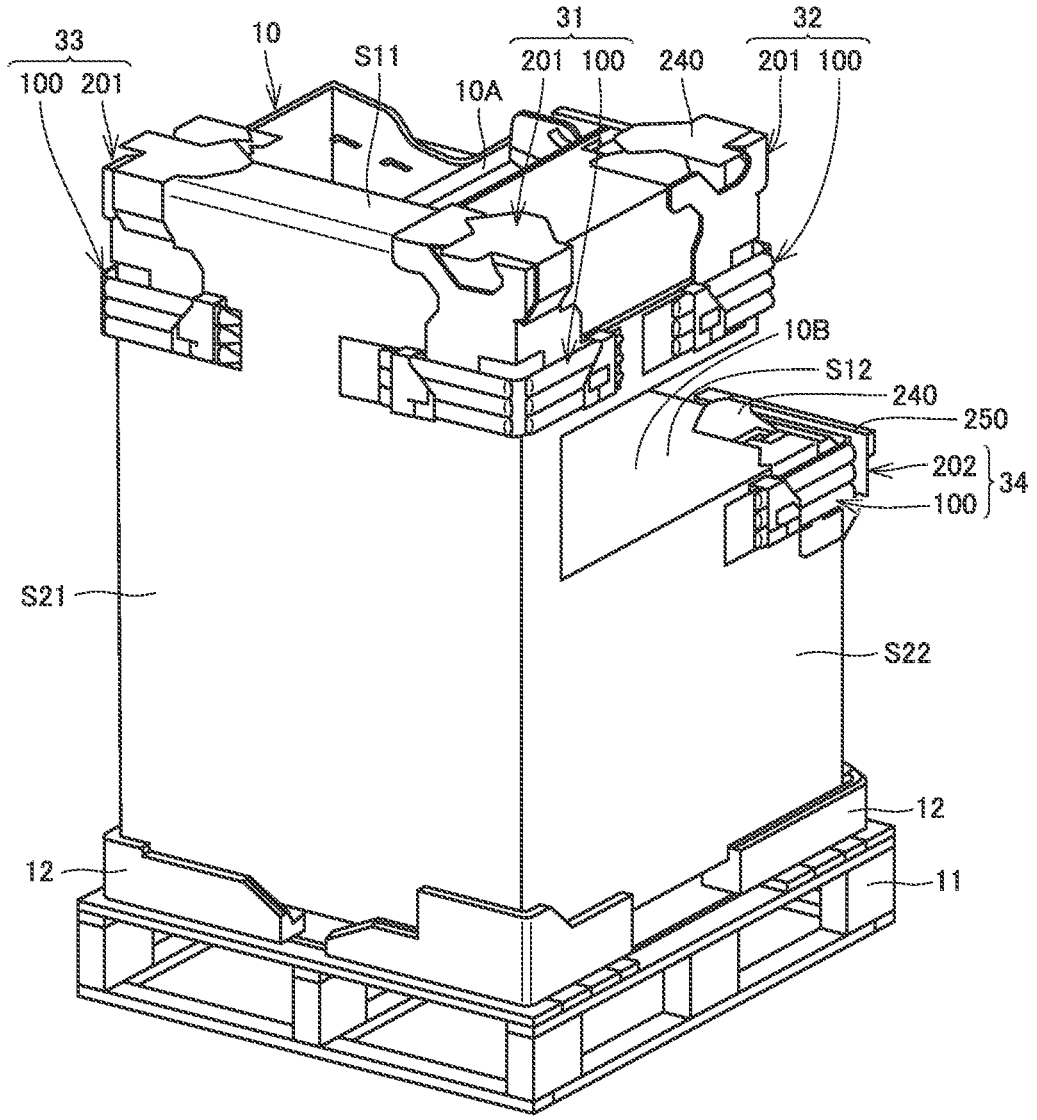
FIG. 2 is a diagram showing a state that an exterior box has been removed from the packing body shown in FIG. 1.

FIG. 1 is a perspective view schematically showing a packing body in one embodiment of the present invention. FIG. 2 is a diagram showing a state that an exterior box has been removed from the packing body shown in FIG. 1.

As shown in FIGS. 1 and 2, a packing body 1 includes an object 10, a palette 11, a plurality of foams 12, an exterior box 20, a fixing member 21, and a plurality of cushioning members 31 to 34. Palette 11, the plurality of foams 12, exterior box 20, fixing member 21, and the plurality of cushioning members 31 to 34 are used in packing object 10.

An image forming apparatus is adopted as object 10 in the present embodiment. Object 10 includes a scanning portion 10A and a paper ejection portion 10B.

Palette 11 is a member that supports object 10. Palette 11 is composed of combination of board materials made of lumber. Palette 11 may be formed from a resin member.

Each foam 12 is a formed product of expanded polystyrene. Each foam 12 is provided to support the bottom of object 10 and to abut on a side surface of object 10. Each foam 12 is formed in conformity with four corners of object 10.

Exterior box 20 is in a shape covering object 10. A lid 20A that can be opened and closed is formed at the top of exterior box 20. Exterior box 20 is made of corrugated cardboard or the like.

Each of cushioning members 31 to 34 is arranged between object 10 and exterior box 20. Each of cushioning members 31 to 34 suppresses transmission of external force applied to exterior box 20 to object 10. As shown in FIG. 2, cushioning members 31 to 33 are arranged to be engaged with scanning portion 10A and cushioning member 34 is arranged to be engaged with paper ejection portion 10B. More specifically, cushioning members 31 to 33 are arranged at corners of scanning portion 10A and cushioning member 34 is arranged at a corner of paper ejection portion 10B. Since cushioning members 31 to 33 are substantially identical in structure to one another, cushioning member 31 among cushioning members 31 to 33 will be described below by way of example.

Figure 3:
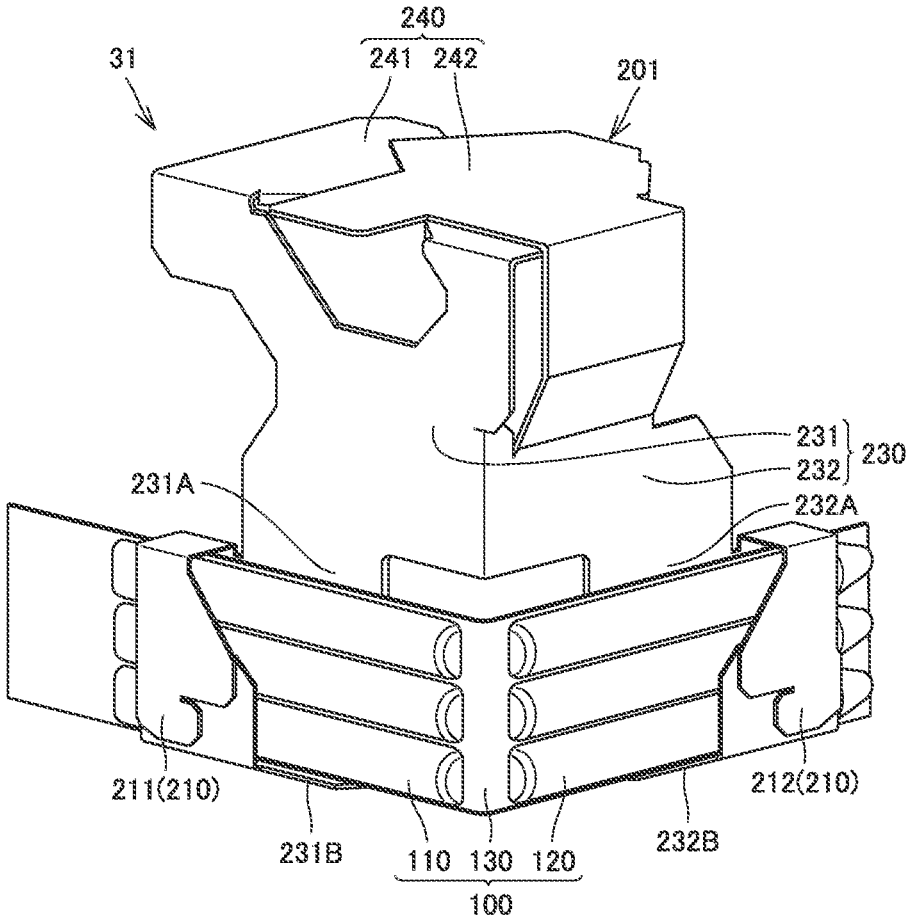
FIGS. 3 and 4 are perspective views of a cushioning member shown in FIG. 2.

As shown in FIG. 3, cushioning member 31 includes a cushioning material 100 and a positioning member 201.

Cushioning material 100 includes a resin sheet welded like a bag and a medium (air in the present embodiment) sealed in the resin sheet. In the present embodiment, what is called an indefinite-shape cushioning material (a deformable cushioning material in conformity with a gap between object 10 and exterior box 20) is employed as cushioning material 100. Cushioning material 100 includes a first cushioning portion 110, a second cushioning portion 120, and a connection portion 130.

First cushioning portion 110 is in a shape extending long in one direction. Second cushioning portion 120 is formed at a position distant from first cushioning portion 110 in one direction and in a shape extending long in one direction. A medium is sealed in first cushioning portion 110 and second cushioning portion 120. Connection portion 130 connects first cushioning portion 110 and second cushioning portion 120 to each other.

Figure 4:
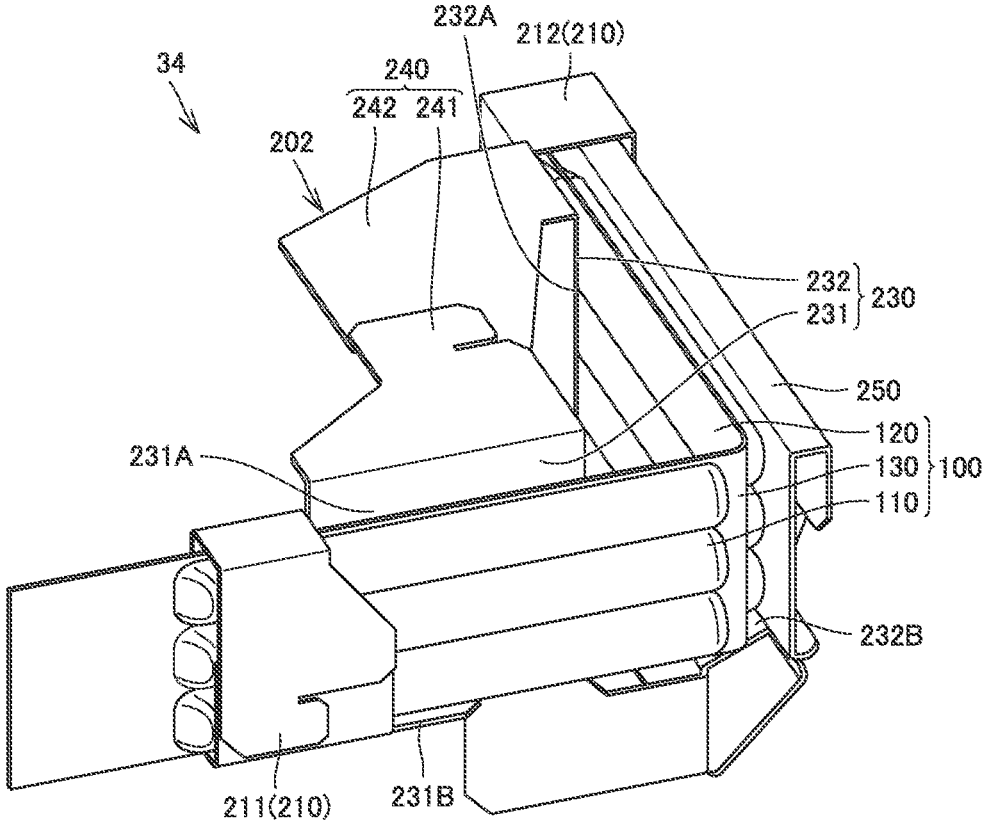

As shown in FIGS. 2 to 4, cushioning material 100 is bendable at connection portion 130. In other words, connection portion 130 connects first cushioning portion 110 and second cushioning portion 120 to each other so as to allow bending of second cushioning portion 120 with respect to first cushioning portion 110. Therefore, as shown in FIG. 2, cushioning material 100 of cushioning member 31 is arranged such that first cushioning portion 110 faces one side surface S21 of object 10 and second cushioning portion 120 faces a side surface S22 adjacent to one side surface S21 of object 10. Cushioning material 100 can also be arranged such that both of first cushioning portion 110 and second cushioning portion 120 face only any one side surface of object 10.

Connection portion 130 preferably includes a coupling flow path (not shown) that couples first cushioning portion 110 and second cushioning portion 120 to each other. In this case, the coupling flow path is smaller in cross-sectional area than first cushioning portion 110 and second cushioning portion 120. Thus, for example, when external force is applied to second cushioning portion 120, resistance is produced at the time when the medium passes through the coupling flow path from second cushioning portion 120 toward first cushioning portion 110 and therefore some of energy of shock caused by external force is consumed in the coupling flow path. Therefore, a cushioning function of cushioning material 100 against external force applied to exterior box 20 is enhanced.

Positioning member 201 is a member for positioning of cushioning material 100 with respect to object 10. As shown in FIG. 2, positioning member 201 positions cushioning material 100 at a position set in advance with respect to object 10, by being engaged with an upper surface S11 of scanning portion 10A while the positioning member holds cushioning material 100. Positioning member 201 is made of corrugated cardboard or the like. As shown in FIG. 3, positioning member 201 includes a holding portion 210, a coupling portion 230, and an engagement portion 240.

Holding portion 210 holds cushioning material 100. Holding portion 210 includes a first holding piece 211 and a second holding piece 212.

First holding piece 211 is a part that holds first cushioning portion 110. First holding piece 211 is in a shape surrounding first cushioning portion 110. First holding piece 211 holds first cushioning portion 110 with first cushioning portion 110 being inserted therein.

Second holding piece 212 is a part that holds second cushioning portion 120. Second holding piece 212 is in a shape surrounding second cushioning portion 120. Second holding piece 212 holds second cushioning portion 120 with second cushioning portion 120 being inserted therein.

Engagement portion 240 is a part engaged with upper surface S11 of scanning portion 10A. Specifically, engagement portion 240 is engaged with upper surface S11 of object 10 while cushioning material 100 held by holding portion 210 is located at a position set in advance in the side surface of object 10. Details of engagement portion 240 will be described later.

Coupling portion 230 is a part that couples holding portion 210 and engagement portion 240 to each other. Specifically, coupling portion 230 includes a first coupling piece 231 and a second coupling piece 232.

First coupling piece 231 couples first holding piece 211 and engagement portion 240 to each other. First coupling piece 231 includes a first interposed portion 231A and a first support portion 231B. First interposed portion 231A is a part interposed between first cushioning portion 110 held by first holding piece 211 and side surface S21 of object 10. First interposed portion 231A is formed in parallel to side surface S21. First support portion 231B is a part that supports first cushioning portion 110 held by first holding piece 211. First support portion 231B is bent with respect to first interposed portion 231A.

Second coupling piece 232 couples second holding piece 212 and engagement portion 240 to each other and is connected to first coupling piece 231. Second coupling piece 232 is bent with respect to first coupling piece 231 such that first coupling piece 231 faces side surface S21 and second coupling piece 232 faces side surface S22. Second coupling piece 232 includes a second interposed portion 232A and a second support portion 232B. Second interposed portion 232A is a pan interposed between second cushioning portion 120 held by second holding piece 212 and side surface S22 of object 10. Second interposed portion 232A is formed in parallel to side surface S22. Second support portion 2328 is a part that supports second cushioning portion 120 held by second holding piece 212. Second support portion 232B is bent with respect to second interposed portion 232A.

Engagement portion 240 will now be described in detail. Engagement portion 240 is connected to an upper end of coupling portion 230. Engagement portion 240 is engaged with upper surface S11 such that first coupling piece 231 faces side surface S21 and second coupling piece 232 faces side surface S22. In other words, coupling portion 230 couples first holding piece 211, second holding piece 212, and engagement portion 240 to one another such that first holding piece 211 that holds first cushioning portion 110 is located between side surface S21 and exterior box 20, second holding piece 212 that holds second cushioning portion 120 is located between side surface S22 and exterior box 20, and engagement portion 240 is engaged with upper surface S11 of object 10.

In the present embodiment, engagement portion 240 includes a first engagement piece 241 connected to the upper end of first coupling piece 231 and a second engagement piece 242 connected to the upper end of second coupling piece 232. First engagement piece 241 is bent with respect to first coupling piece 231 as extending along upper surface S11. Second engagement piece 242 is bent with respect to second coupling piece 232 as extending along upper surface S11. Second engagement piece 242 is fixed to a part of first engagement piece 241 as being superimposed on that part.

Cushioning member 34 will now be described with reference to FIG. 4. Cushioning member 34 includes cushioning material 100 and a positioning member 202.

Positioning member 202 corresponds in structure to positioning member 201 except for including a structured portion 250. Therefore, only structured portion 250 will be described in connection with positioning member 202.

Structured portion 250 is a part with which a gap between cushioning material 100 held by holding portion 210 and exterior box 20 is filled. In the present embodiment, structured portion 250 is connected to second holding piece 212. Structured portion 250 is in such a shape that a gap between second cushioning portion 120 held by second holding piece 212 and exterior box 20 is filled with the structured portion.

An exemplary procedure of packing object 10 will now be described.

In packing object 10, initially, a plurality of foams 12 are arranged on palette 11 and object 10 wrapped in a protective plastic bag (not shown) is arranged on each foam 12. In that state, exterior box 20 that opens downward is placed from above object 10 and each foam 12.

Then, while lid 20A of exterior box 20 is open, cushioning members 31 to 34 are arranged at the corners of object 10 from above object 10. Specifically, cushioning members 31 to 33 are arranged at the corners of scanning portion WA such that engagement portion 240 is engaged with upper surface S11, and cushioning member 34 is arranged at the corner of paper ejection portion 10B such that engagement portion 240 is engaged with upper surface S12.

Thereafter, lid 20A of exterior box 20 is closed, and exterior box 20 and palette 11 are fixed by fixing member 21 such as a plastic tape.

As set forth above, packing body 1 is composed by coverage of object 10 and cushioning members 31 to 34 with exterior box 20 while cushioning material 100 held by holding portion 210 is located at a position set in advance in the side surface of object 10 and engagement portion 240 is engaged with upper surfaces S11 and S12 of object 10.

As described above, with cushioning members 31 to 34 in the present embodiment, engagement portion 240 is engaged with upper surfaces S11 and S12 of object 10 while cushioning material 100 held by holding portion 210 is located at the position set in advance in the side surface of object 10 so that cushioning material 100 can be positioned with respect to the side surface of object 10 without using a dedicated member for positioning of cushioning members 31 to 34 with respect to object 10.

In the present embodiment, engagement portion 240 is engaged with upper surfaces S11 and S12 of object 10 while first cushioning portion 110 is arranged over one side surface of object 10 and second cushioning portion 120 is arranged over the side surface adjacent to one side surface, that is, cushioning material 100 is arranged to extend over a corner formed by side surfaces of object 10 adjacent to each other. Therefore, displacement of the position of cushioning material 100 with respect to the side surface of object 10 from the position set in advance is suppressed.

Since second coupling piece 232 is bent with respect to first coupling piece 231, displacement of the position of cushioning material 100 with respect to the side surface of object 10 from the position set in advance is more reliably suppressed.

First coupling piece 231 includes first interposed portion 231A and first support portion 231B and second coupling piece 232 includes second interposed portion 232A and second support portion 232B. Therefore, a posture of cushioning material 100 held by each of holding pieces 211 and 212 is stabilized.

Since positioning member 202 includes structured portion 250, relative displacement of cushioning member 34 with respect to object 10 within exterior box 20 due to vibration or the like during transportation is suppressed.

In packing body 1 in the present embodiment, cushioning material 100 is positioned with respect to the side surface of object 10 without using a dedicated member for positioning of cushioning members 31 to 34 with respect to object 10.

In the embodiment, for example, coupling portion 230 may couple first holding piece 211, second holding piece 212, and engagement portion 240 to one another while first holding piece 211 that holds first cushioning portion 110 and second holding piece 212 that holds second cushioning portion 120 are both located between one side surface of object 10 and exterior box 20 and engagement portion 240 is engaged with upper surfaces S11 and S12 of object 10.

Cushioning material 100 may include only a single cushioning portion and holding portion 210 may hold the cushioning portion.

Cushioning material 100 may be made of what is called a definite-shape cushioning material such as a formed product of expanded polystyrene.

Figure 5:
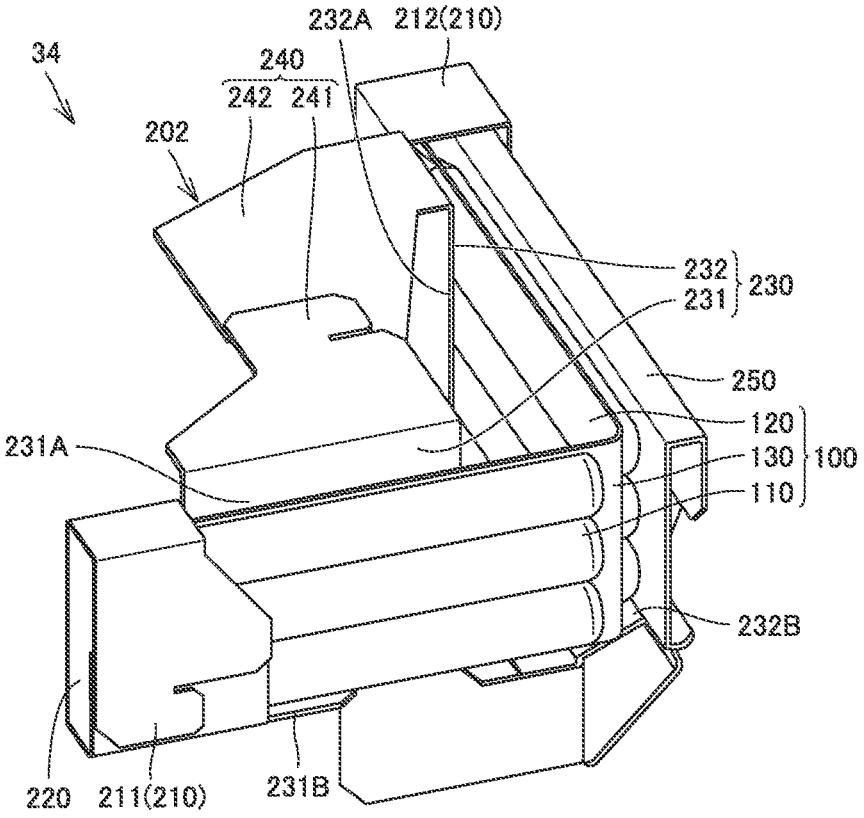
FIG. 5 is a perspective view of a modification of the cushioning member.

As shown in FIG. 5, positioning members 201 and 202 may include a closing portion 220 that closes an opening in holding portion 210.

A person skilled in the art would understand that the exemplary embodiment described above represents a specific example of a manner below.

A cushioning member according to the embodiment is arranged between an object including an upper surface and a plurality of side surfaces and an exterior box in which the object is packed, and the cushioning member includes a cushioning material arranged between a side surface of the object and the exterior box and a positioning member for positioning of the cushioning material with respect to the object. The positioning member includes a holding portion that holds the cushioning material, an engagement portion engaged with the upper surface of the object while the cushioning material held by the holding portion is located at a position set in advance in the side surface of the object, and a coupling portion that couples the holding portion and the engagement portion to each other.

In the cushioning member, since the engagement portion is engaged with the upper surface of the object while the cushioning material held by the holding portion is located at the position set in advance in the side surface of the object, the cushioning material can be positioned with respect to the side surface of the object without using a dedicated member for positioning of the cushioning member with respect to the object.

The cushioning material may include a first cushioning portion, a second cushioning portion, and a connection portion that connects the first cushioning portion and the second cushioning portion to each other so as to allow bending of the second cushioning portion with respect to the first cushioning portion. The holding portion may include a first holding piece that holds the first cushioning portion and a second holding piece that holds the second cushioning portion. In this case, preferably, the coupling portion couples the first holding piece, the second holding piece, and the engagement portion to one another while the first holding piece that holds the first cushioning portion is located between one side surface of the plurality of side surfaces and the exterior box, the second holding piece that holds the second cushioning portion is located between a side surface adjacent to the one side surface of the plurality of side surfaces and the exterior box, and the engagement portion is engaged with the upper surface of the object.

By doing so, the engagement portion is engaged with the upper surface of the object while the first cushioning portion is arranged over one side surface of the object and the second cushioning portion is arranged over the side surface adjacent to one side surface, that is, the cushioning material is arranged to extend across a corner formed by side surfaces of the object adjacent to each other. Therefore, displacement of the position of the cushioning material with respect to the side surface of the object from the position set in advance is suppressed.

Preferably, the coupling portion includes a first coupling piece that couples the first holding piece and the engagement portion to each other and a second coupling piece that couples the second holding piece and the engagement portion to each other and is connected to the first coupling piece, and the second coupling piece is bent with respect to the first coupling piece.

By doing so, displacement of the position of the cushioning material with respect to the side surface of the object from the position set in advance is more reliably suppressed.

Preferably, the first coupling piece includes a first interposed portion interposed between the first cushioning portion held by the first holding piece and the one side surface of the object and a first support portion that supports the first cushioning portion held by the first holding piece, and the second coupling piece includes a second interposed portion interposed between the second cushioning portion held by the second holding piece and a side surface adjacent to the one side surface of the object and a second support portion that supports the second cushioning portion held by the second holding piece.

By doing so, the posture of the cushioning material held by each holding piece is stabilized.

Preferably, the holding portion is in a shape surrounding the cushioning material.

By doing so, the cushioning material is held in a stable manner.

Preferably, the positioning member further includes a closing portion that closes an opening in the holding portion.

By doing so, detachment of the cushioning material from the holding portion is suppressed.

The positioning member preferably further includes a structured portion with which a gap between the cushioning material held by the holding portion and the exterior box is filled.

By doing so, relative displacement of the cushioning member with respect to the object within the exterior box due to vibration or the like during transportation is suppressed.

A packing body according to the embodiment includes the cushioning member, the object, and the exterior box. The engagement portion is engaged with the upper surface of the object while the cushioning material held by the holding portion is located at the position set in advance in the side surface of the object.

A packing method according to the embodiment is a packing method of packing the object in the exterior box by using the cushioning member. In the packing method, the object and the cushioning member are covered with the exterior box while the cushioning material held by the holding portion is located at the position set in advance in the side surface of the object and the engagement portion is engaged with the upper surface of the object.

Although embodiments of the present invention have been described and illustrated in detail, the disclosed embodiments are made for the purposes of illustration and example only and not limitation. The scope of the present invention should be interpreted by terms of the appended claims.

What is claimed is:

1. A cushioning member arranged between an object including an upper surface and a plurality of side surfaces and an exterior box in which the object is packed, the cushioning member comprising:

a cushioning material arranged between a side surface of the object and the exterior box; and a positioning member for positioning of the cushioning material with respect to the object, the positioning member including a holding portion that holds the cushioning material, a structured portion positioned on an exterior side of the cushioning member, between the cushioning material and the exterior box, such that the cushioning material is disposed between the side surface of the object and the structured portion, wherein the structured portion is held by the holding portion, which also holds the cushioning material, and fills a gap between the cushioning material and the exterior box, an engagement portion engaged with the upper surface of the object while the cushioning material held by the holding portion is located at a position set in advance in the side surface of the object, and a coupling portion that couples the holding portion and the engagement portion to each other.

2. The cushioning member according to claim 1, wherein the cushioning material includes a first cushioning portion, a second cushioning portion, and a connection portion that connects the first cushioning portion and the second cushioning portion to each other so as to allow bending of the second cushioning portion with respect to the first cushioning portion, the holding portion includes a first holding piece that holds the first cushioning portion, and a second holding piece that holds the second cushioning portion, and the coupling portion couples the first holding piece, the second holding piece, and the engagement portion to one another while the first holding piece that holds the first cushioning portion is located between one side surface of the plurality of side surfaces and the exterior box, the second holding piece that holds the second cushioning portion is located between a side surface adjacent to the one side surface of the plurality of side surfaces and the exterior box, and the engagement portion is engaged with the upper surface of the object.

3. The cushioning member according to claim 2, wherein the coupling portion includes a first coupling piece that couples the first holding piece and the engagement portion to each other, and a second coupling piece that couples the second holding piece and the engagement portion to each other and is connected to the first coupling piece, and the second coupling piece is bent with respect to the first coupling piece.

4. The cushioning member according to claim 3, wherein the first coupling piece includes a first interposed portion interposed between the first cushioning portion held by the first holding piece and the one side surface of the object, and a first support portion that supports the first cushioning portion held by the first holding piece, and the second coupling piece includes a second interposed portion interposed between the second cushioning portion held by the second holding piece and a side surface adjacent to the one side surface of the object, and a second support portion that supports the second cushioning portion held by the second holding piece.

5. The cushioning member according to claim 1, wherein the holding portion is in a shape surrounding the cushioning material.

6. The cushioning member according to claim 5, wherein the positioning member further includes a closing portion that closes an opening in the holding portion.

7. A packing body comprising:

the cushioning member according to claim 1;

the object; and the exterior box, the engagement portion being engaged with the upper surface of the object while the cushioning material held by the holding portion is located at the position set in advance in the side surface of the object.

8. A packing method of packing the object in the exterior box by using the cushioning member according to claim 1, the object and the cushioning member being covered with the exterior box while the cushioning material held by the holding portion is located at the position set in advance in the side surface of the object and the engagement portion is engaged with the upper surface of the object.

* * * * *